US006318980B1

(12) United States Patent
Kurihara et al.

(10) Patent No.: US 6,318,980 B1
(45) Date of Patent: Nov. 20, 2001

(54) SHAPE OF SUCTION HOLE AND DISCHARGE HOLE OF REFRIGERANT COMPRESSOR

(75) Inventors: Masayuki Kurihara; Iwao Uchikado, both of Isesaki; Yoshio Kimura, Maebashi; Tetsuya Noda, Isesaki; Kazuhiko Takai, Sawa-gun, all of (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/466,662

(22) Filed: Dec. 20, 1999

Related U.S. Application Data

(63) Continuation-in-part of application No. 09/213,254, filed on Dec. 17, 1998.

(30) Foreign Application Priority Data

Dec. 26, 1997 (JP) ..... 9-360037
Dec. 24, 1998 (JP) ..... 10-367166

(51) Int. Cl.[7] ..... F04B 39/10; F04B 53/10
(52) U.S. Cl. ..... 417/571; 137/856
(58) Field of Search ..... 417/269, 539, 417/569, 571

(56) References Cited

U.S. PATENT DOCUMENTS

| | | | | |
|---|---|---|---|---|
| 4,580,604 | | 4/1986 | Kawaguchi et al. . | |
| 4,642,037 | * | 2/1987 | Fritchman | 417/571 |
| 4,721,443 | * | 1/1988 | Allen | 417/539 |
| 4,778,360 | * | 10/1988 | Ikeda et al. | 417/571 |
| 4,820,133 | * | 4/1989 | Steele et al. | 417/269 |
| 5,100,306 | * | 3/1992 | Moram, Jr. et al. | 417/571 |
| 5,266,016 | * | 11/1993 | Kandpal | 417/569 |
| 5,558,508 | * | 9/1996 | Sasano et al. | 417/569 |
| 5,577,901 | * | 11/1996 | Yoon | 417/571 |
| 5,632,609 | * | 5/1997 | Hashimoto | 417/571 |
| 5,655,898 | * | 8/1997 | Hashimoto et al. | 417/569 |
| 5,672,053 | * | 9/1997 | Sabha | 417/569 |
| 5,885,064 | * | 3/1999 | Mccoy | 417/569 |

FOREIGN PATENT DOCUMENTS

| | | |
|---|---|---|
| 2451207 | 5/1976 | (DE) . |
| 2596815 | 10/1987 | (FR) . |
| 760815 | 12/1956 | (GB) . |
| 56-105683 | 8/1981 | (JP) . |

OTHER PUBLICATIONS

European Search Report (EPA 98124026.0–2315–) (Jan. 21, 2000).

* cited by examiner

*Primary Examiner*—Teresa Walberg
*Assistant Examiner*—Leonid Fastovsky
(74) *Attorney, Agent, or Firm*—Baker Botts L.L.P.

(57) ABSTRACT

Discharge holes and suction holes having shapes that suppress the turbulence of a refrigerant gas flow are disclosed. The shape of the discharge hole according to the present invention has a tapered surface wall, such that the circumference of the discharge hole increases from the piston cylinder surface to the discharge chamber surface. Similarly, the shape of the suction hole according to the present invention has a tapered surface wall such that the circumference of the suction hole increases from the suction chamber surface to the piston cylinder surface. The present invention allows the flow path of the refrigerant gas to flow approximately tangential to the valve reed by providing a tapered surface wall. The flow resistance of the discharge hole or the suction hole is reduced such that the volume efficiency of the compressor is improved and compressor noise is suppressed.

22 Claims, 10 Drawing Sheets

Discharge chamber side

Piston cylinder side

Discharge chamber side

Piston cylinder side

Discharge chamber side

Piston cylinder side

Discharge chamber side

Piston cylinder side

Discharge chamber side

Piston cylinder side

Discharge chamber side

Piston cylinder side

Discharge chamber side

Piston cylinder side

Discharge chamber side

Piston cylinder side

Discharge chamber side

Piston cylinder side

Discharge chamber side

Piston cylinder side

SHAPE OF SUCTION HOLE AND DISCHARGE HOLE OF REFRIGERANT COMPRESSOR

This is a continuation-in-part patent application of Ser. No. 09/213,254, filed on Dec. 17, 1998.

BACKGROUND OF THE INVENTION

1. Field of the Invention

The present invention relates to a refrigerant compressor used for an automotive air-conditioning system. More particularly, the present invention relates to shapes of suction holes and discharge holes provided in a valve plate of a compressor.

2. Description of the Related At

A description of the structure and operation of a refrigerant compressor for an automotive air conditioning system follows. Referring to FIG. 1, a conventional compressor 100 is depicted. Compressor 100 comprises front housing 30, housing 27, valve plate 1, and rear housing 32. Along the central axis of compressor 100 is provided a drive shaft 34, which is supported rotatably by needle bearings 35 and 36. Within housing 27, cam rotor 37 which is fixed to drive shaft 34 engages the inner wall of front housing 30 via thrust bearing 38. Cam rotor 37 rotates when drive shaft 34 is rotated. Hinge mechanism 39 couples cam rotor 37 with inclined plate 40. Inclined plate 40 rotates with cam rotor 37. Wobble plate 43 engages with inclined plate 40 via thrust bearing 41 and needle bearing 42. A wobbling motion is induced in inclined plate 40, so that inclined plate 40 wobbles while rotating. This motion of inclined plate 40 transfers to wobble plate 43. Rotation of wobble plate 43 is inhibited by engagement with a guide bar 44. Therefore, only the wobbling component of the motion of inclined plate 40 is transferred from inclined plate 40 to wobble plate 43. Wobble plate 43 has a wobbling motion, but does not rotate with drive shaft 34. Rod 45 is connected by spherical coupling to wobble plate 43 and to a plurality of pistons 46. When wobble plate 43 wobbles, each of pistons 46 reciprocates in one of a plurality of cylinders 71.

Suction valve reed 22, discharge valve reed 2, and valve retainer 3 are fixed by bolt 47 to valve plate 1. Suction holes 5 and discharge holes 4 correspond to each piston cylinder 71. Suction chamber 72 and discharge chamber 70 are formed by valve plate 1 and the rear housing 32, and are separated by inside partition plate 33.

When drive shaft 34 is rotated by an external power source (not shown), each piston 46 reciprocates in its respective piston cylinder 71. When piston 46 is moving leftward in FIG. 1, the suction phase is executed, and when piston 46 is moving rightward, the compression phase is executed.

In the suction phase, refrigerant gas in suction chamber 72 is drawn into piston cylinder 71 through suction hole 5. Due to the pressure variance between suction chamber 72 and piston cylinder 71, the refrigerant gas in suction chamber 72 flows to suction hole 5, passes through suction hole 5, opens suction valve reed 22, and enters piston cylinder 71. Suction valve reed 22 prohibits a reverse flow of refrigerant gas into suction chamber 72 during the compression phase.

In the compression phase, the refrigerant gas in piston cylinder 71 is discharged into discharge chamber 70 through discharge hole 4. Due to the pressure variance between piston cylinder 71 and discharge chamber 70, the refrigerant gas passes through discharge hole 4, opens discharge valve reed 2, and enters discharge chamber 70. Discharge valve reed 2 prohibits a reverse flow of the refrigerant gas into piston cylinder 71 during the suction phase.

FIG. 2*a* depicts a cross-sectional view of valve plate 1 from the rear housing side of valve plate 1. FIG. 2*b* depicts a cross-sectional view of valve plate 1 from the cylinder head side of valve plate 1. With reference to FIG. 2*a*, rear housing 32 is fixed to housing 27 by a plurality of bolts 130. Suction holes 5 and discharge holes 4 are disposed equiangularly around the center CO and correspond to piston cylinders 71. Suction chamber 72 and discharge chamber 70 are separated by inside partition plate 33. Discharge valve reed 2 within inside partition plate 33 is substantially star-shaped. The arms of discharge valve reed 2 cover discharge holes 4. With reference to FIG. 2*b*, suction valve reed 22 also is substantially star-shaped. Within each arm, a hole 22*h* enables the discharge gas to flow therethrough.

FIG. 3 depicts valve plate 1 as viewed from the side of valve plate 1 facing discharge chamber 70. Discharge holes 4 and suction holes 5 are disposed equiangularly with respect to the center C of valve plate 1. FIG. 4 and FIG. 5 are corresponding radial, cross- sectional views of valve plate 1 of FIG. 1. Valve reed 2 is fixed between valve plate 1 and valve retainer 3. Discharge holes 4 have side walls which are substantially perpendicular to the opposing surfaces of valve plate 1.

FIG. 4 and FIG. 5 depict valve plate 1 during the compression phase. When the refrigerant gas is discharged from cylinders 71, it strikes, pushes, and displaces valve reed 2. The refrigerant gas flows into discharge chamber 70 through a gap created between valve reed 2 and valve plate 1. When refrigerant gas flow impinges against reed valve 2 in FIG. 4, its flow path may be diverted at an angle substantially perpendicular to valve plate 1. Turbulence in the refrigerant gas flow may be created due to the abrupt change in the direction of flow. Further, a portion of the refrigerant gas flow impinging against valve reed 2 may not enter discharge chamber 70, and may instead return to piston cylinder 71. These turbulence effects are indicated by the arrows in FIG. 4 and FIG. 5. Therefore, turbulence of the refrigerant gas flow may result in flow resistance at discharge hole 4. Such flow resistance lowers the volumetric efficiency, a primary measure of the performance of compressor 100. The turbulence of flow also disturbs the motion of valve reed 2 and impedes valve reed 2 from discretely and completely opening and closing. Moreover, the turbulence of flow in discharge holes 4 may cause noise in compressor 100. Similar problems may occur with respect to suction holes 5.

Thus, it has long been desired to resolve effectively the problem of the turbulence of refrigerant gas flowing through the suction holes and discharge holes and to suppress noise generated thereby.

SUMMARY OF THE INVENTION

Therefore, a need has arisen to effectively resolve the problem of turbulence of refrigerant gas flowing through the suction holes and discharge holes, so that refrigerant flow is not impeded, and noise is suppressed. It is an object of the present invention to provide a shape for such suction holes and discharge holes in a valve plate of a compressor that improves the volumetric efficiency of the compressor and suppresses noise. It is another object of the present invention to provide shapes of such suction holes and discharge holes that may suppress the occurrence of turbulence of the refrigerant gas flow to lower impedance to refrigerant gas passing through the suction holes or the discharge holes, or both.

A compressor according to the present invention is equipped with a valve plate that has suction passages and discharge passages. Regarding the discharge passages, each of the discharge passages includes a first piston cylinder-side opening having a first piston cylinder-side opening area, a discharge chamber-side opening having a discharge chamber-side opening area, and a sidewall extending between the openings. At least a portion of the discharge passage sidewall is tapered. The discharge chamber-side opening area is greater than the piston cylinder-side opening area. Regarding the suction passages, each of the suction passages includes a second piston cylinder-side opening having a second piston cylinder-side opening area, a suction chamber-side opening having a suction chamber-side opening area, and a sidewall extending between the openings. At least a portion of the suction passage sidewall is tapered. The piston cylinder-side opening area is greater than the suction chamber-side opening area. The sidewalls of the passages may include a substantially cylindrical portion. Further, the tapered portion of the sidewalls of the passages may be less than the thickness of the valve plate. Even with partial tapering, the objects of the present invention may be achieved.

Along the tapered sidewalls of suction holes or discharge holes, or both, the flow path of the refrigerant gas may bend gradually. The flow path of the refrigerant gas does not strike the valve reed perpendicularly, but instead flows along the tapered portion of the sidewall. As a result, any turbulence of the refrigerant is reduced in the suction holes or discharge holes, so that the volumetric efficiency of the compressor may be improved and associated noise suppressed.

Other objects, features, and advantages of this invention will be understood from the following detailed description of the preferred embodiment of this invention with reference to the attached drawings.

BRIEF DESCRIPTION OF THE DRAWINGS

For a more complete understanding of the present invention and its advantages, reference is now made to the following description taken in conjunction with the accompanying drawings, wherein like reference numerals represent like parts.

DETAILED DESCRIPTION OF PREFERRED EMBODIMENTS

Embodiments of the present invention are illustrated in FIGS. 6–29, wherein like numerals are used to denote elements that correspond to like elements depicted in FIGS. 6–29. A detailed explanation of several elements and characteristics of related art compressors has been provided above and, therefore, is here omitted.

Figure 1:
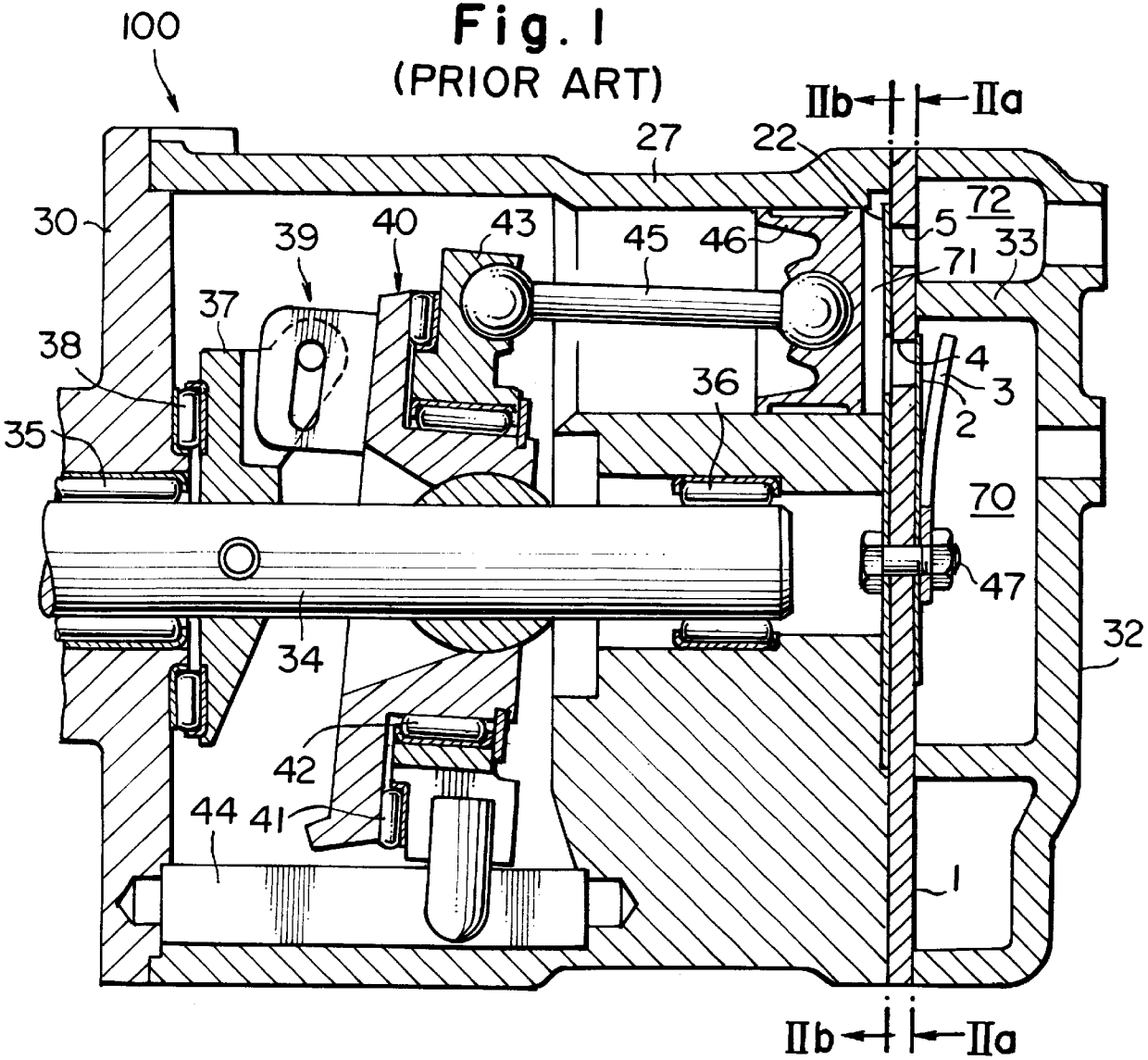
Fig. 1 (PRIOR ART)
FIG. 1 is a cross-sectional view of a conventional compressor.
Figure 2A:
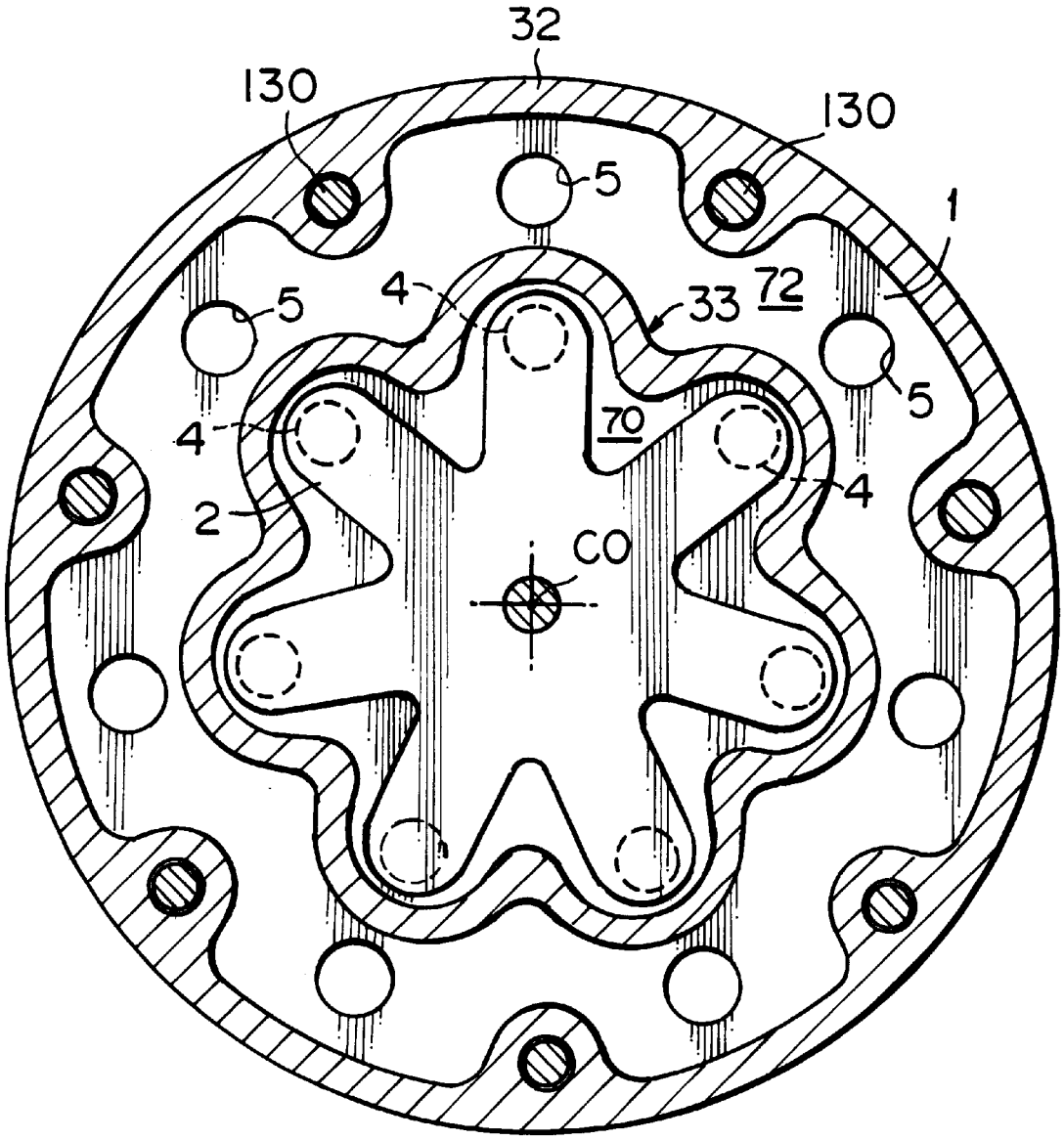
Fig. 2a (PRIOR ART)
FIG. 2*a* is a cross-sectional view along line II*a*—II*a* depicted in FIG. 1.
Figure 2B:
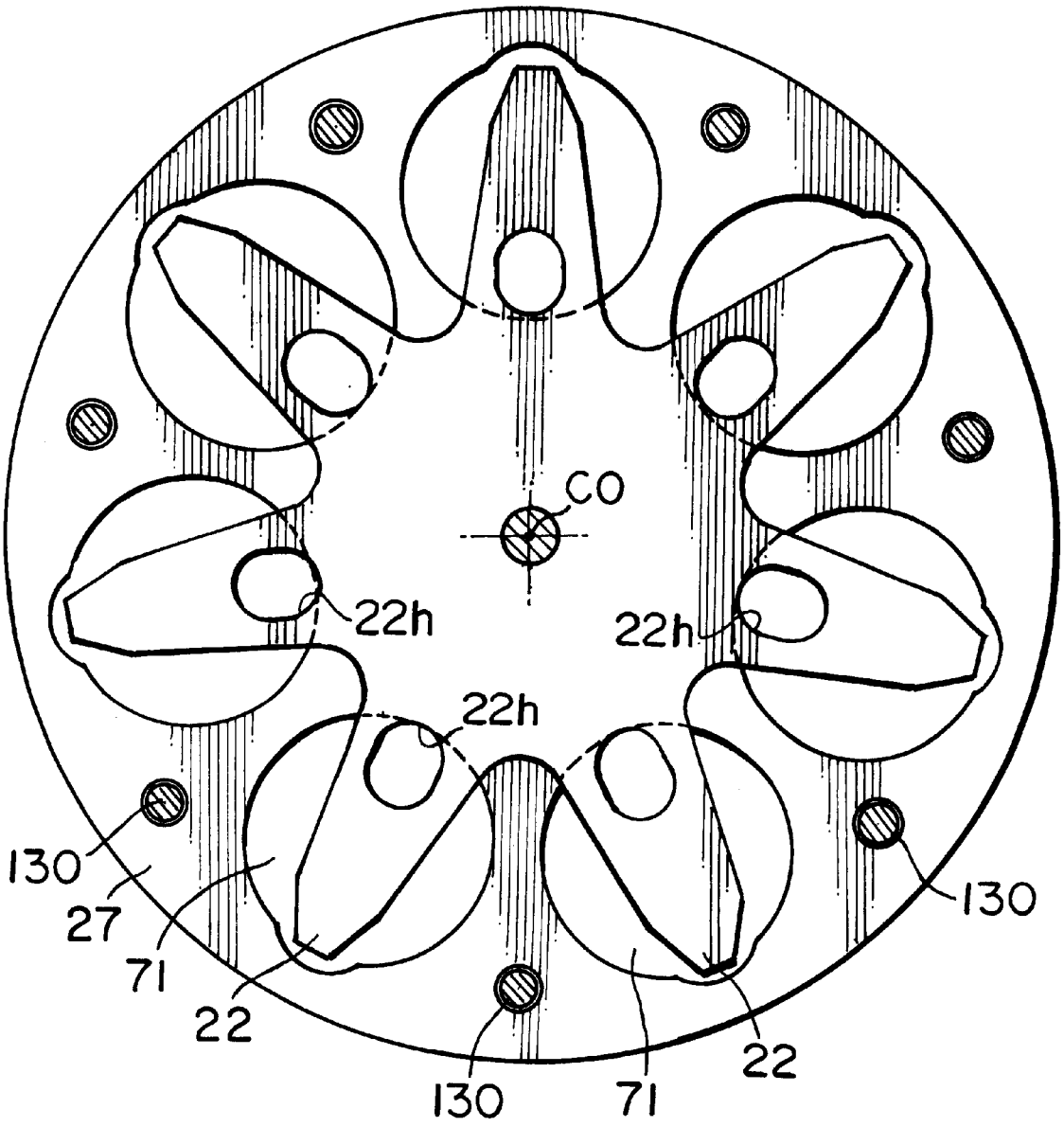
Fig. 2b (PRIOR ART)
FIG. 2*b* is a cross-sectional view along line II*b*—II*b* depicted in FIG. 1.
Figure 3:
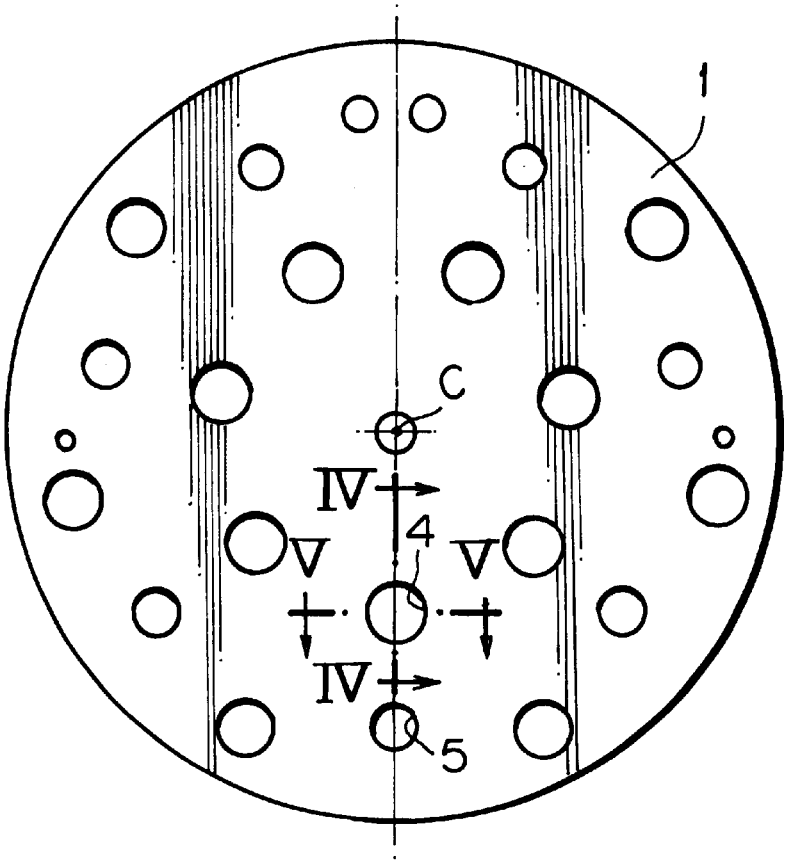
Fig. 3 (PRIOR ART)
FIG. 3 is a plan view of a valve plate according to the compressor of FIG. 1.
Figure 4:
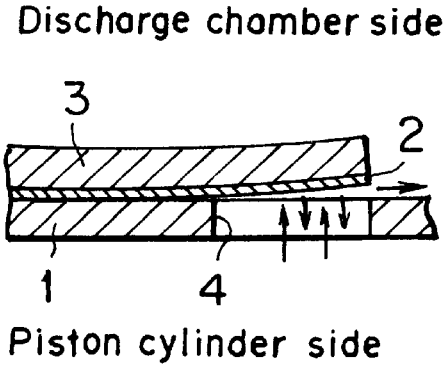
Fig. 4 (PRIOR ART)
FIG. 4 is a cross-sectional view along line IV—IV of the valve plate depicted in FIG. 3.
Figure 5:
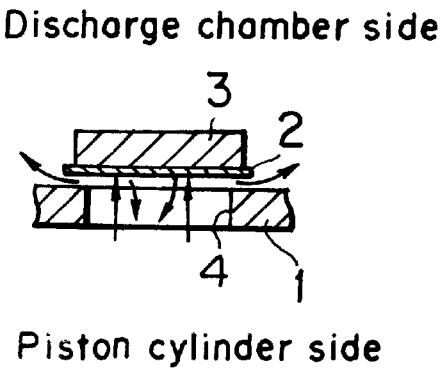
Fig. 5 (PRIOR ART)
FIG. 5 is a cross-sectional view along line V—V of the valve plate depicted in FIG. 3.
Figure 6:
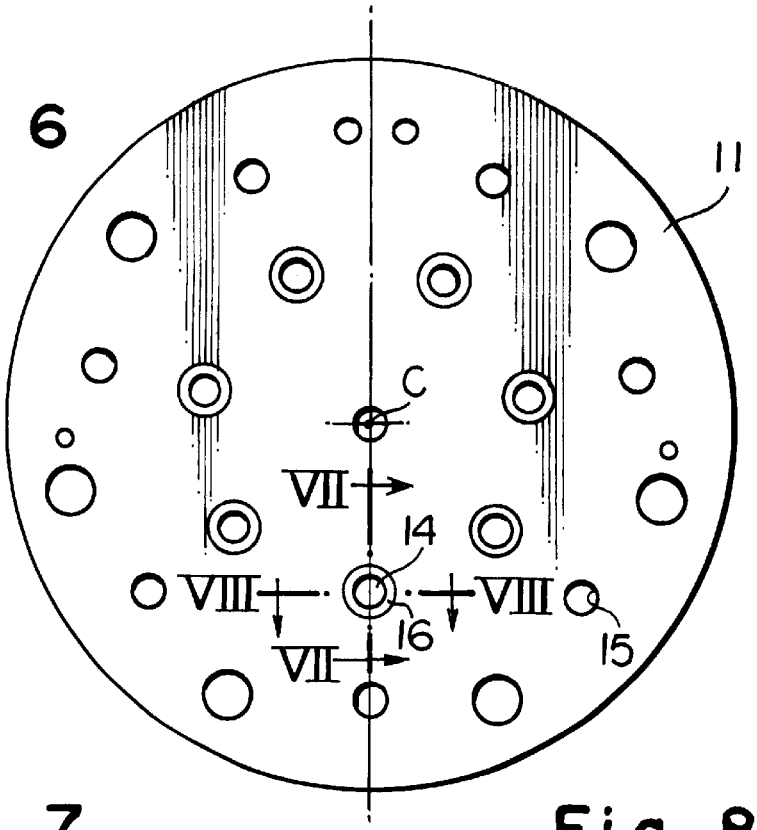
FIG. 6 is a plan view of a valve plate according to an embodiment of the present invention.
Figure 7:
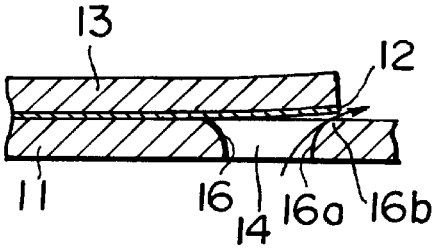
FIG. 7 is a cross-sectional view along line VII—VII of the valve plate depicted in FIG. 6.
Figure 8:
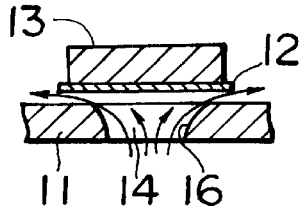
FIG. 8 is a cross-sectional view along line VIII—VIII of the valve plate depicted in FIG. 6.
Figure 9:
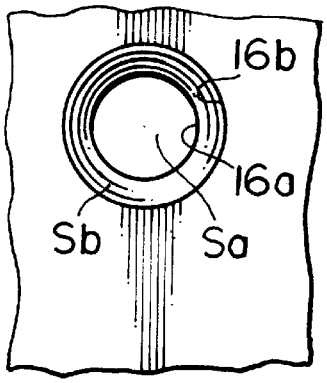
FIG. 9 is a partial plan view of the discharge hole depicted in FIG. 6.

Referring to FIG. 6, a plan view of a valve plate 11 from discharge chamber 70 in accordance to an embodiment of the present invention is depicted. Discharge holes 14 and suction holes 15 are disposed equiangularly in valve plate 11 with respect to center C. FIGS. 7 and 8 are cross-sectional views of the discharge mechanism during a compression phase. Valve reed 12 is fixed between valve plate 11 and valve retainer 13. A sidewall 16 of discharge hole 14 is formed as a convex tapered surface. Small circular opening 16*a* is on the piston cylinder end of sidewall 16. Large circular opening 16*b* is on the discharge chamber end of sidewall 16. Referring to FIG. 9, hole area Sa is defined by small circular opening 16*a*, and hole area Sb is defined by large circular opening 16*b*.

In an embodiment of the present invention, area Sb is about 1.5 times greater than area Sa. The curve of sidewall 16 allows area Sa on the piston cylinder-side surface of valve plate 11 to increase gradually to area Sb on the discharge chamber-side surface of valve plate 11. Thus, the circumference of discharge hole 14 increases from the piston cylinder-side surface to the discharge chamber-side surface of valve plate 11. According to the present invention, a viscous fluid that flows near a wall of a chamber, or tube, flows along the surface. Being a viscous fluid, the refrigerant gas flows along sidewall 16 when discharge hole 14 is open, as indicated by the arrows in FIG. 7 and FIG. 8. The direction of flow of the refrigerant gas gradually bends in a lateral direction according to FIGS. 7 and 8. The refrigerant gas is prevented from colliding directly upon valve reed 12. As a result, turbulence of the refrigerant gas within discharge hole 14 is reduced. Therefore, the shape of discharge hole 14 improves the volumetric efficiency of compressor 100.

Figure 10:
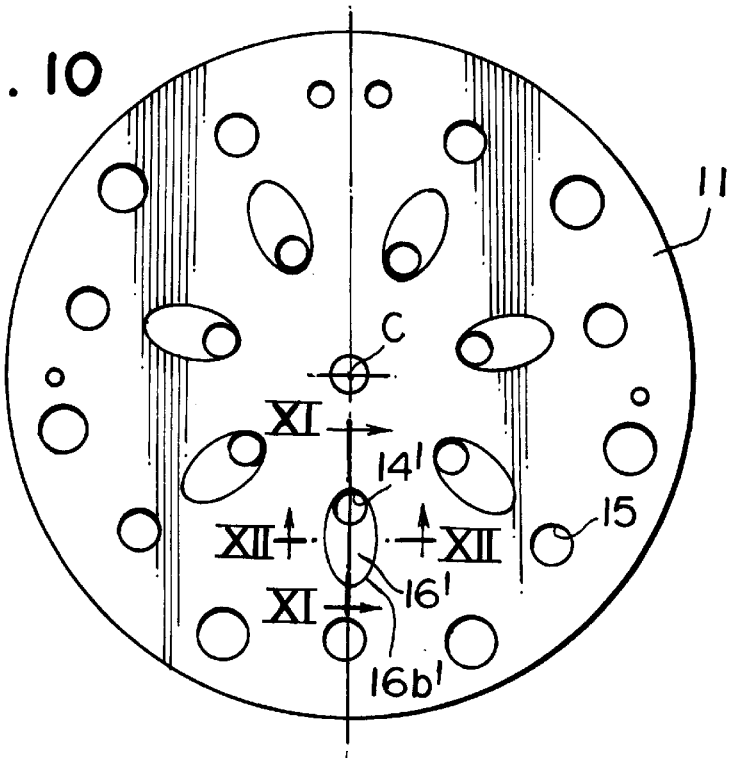
FIG. 10 is a plan view of a valve plate according to another embodiment of the present invention.
Figure 11:
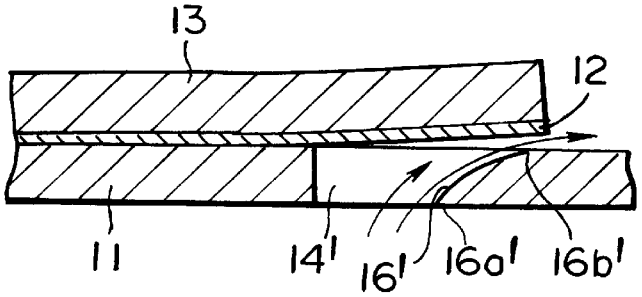
FIG. 11 is a cross-sectional view along line XI—XI of the valve plate depicted in FIG. 10.
Figure 12:
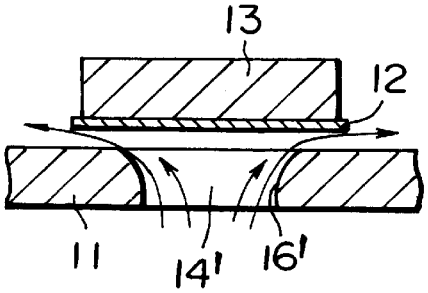
FIG. 12 is a cross-sectional view along line XII—XII of the valve plate depicted in FIG. 10.

FIGS. 10–13 depict another embodiment of the present invention. Referring to FIG. 10, a plan view of valve plate 11 from the discharge chamber-side is depicted. Discharge holes 14' and suction holes 15 are disposed equiangularly in valve plate 11 with respect to the center C. FIGS. 11 and 12 depict the cross-sectional views of the discharge mechanism during the compression phase. Valve reed 12 is fixed between valve plate 11 and valve retainer 13. Discharge hole 14' includes partially convex sidewall 16' and cylindrical portion 19'. Small circular opening 16*a*' is the piston cylinder-end circumference of sidewall 16'. Large elliptical opening 16*b*' is the discharge chamber-end opening of sidewall 16'.

Figure 13:
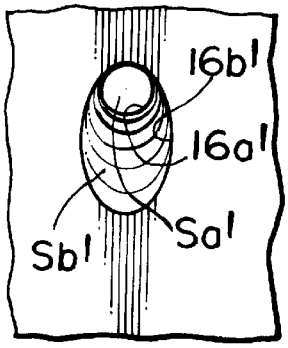
FIG. 13 is a partial plan view of the discharge hole depicted in FIG. 10.

In this embodiment, large elliptical opening 16*b*' extends to only the radially outer side of discharge hole 14' with respect to center C of valve plate 11. Referring to FIG. 13, hole area Sa' is defined by small circular opening 16*a*', and hole area Sb' is defined by large elliptical opening 16*b*'. In this embodiment, area Sb' is about 1.5 times greater than area Sa' . The curve of partially tapered sidewall 16' allows area Sa' on the piston cylinder-side surface of valve plate 11 to increase gradually to area Sb' on the discharge chamber-side surface of valve plate 11. Thus, the circumference of discharge hole 14' increases from the piston cylinder-side surface to the discharge chamber-side surface of valve plate 11.

Figure 14:
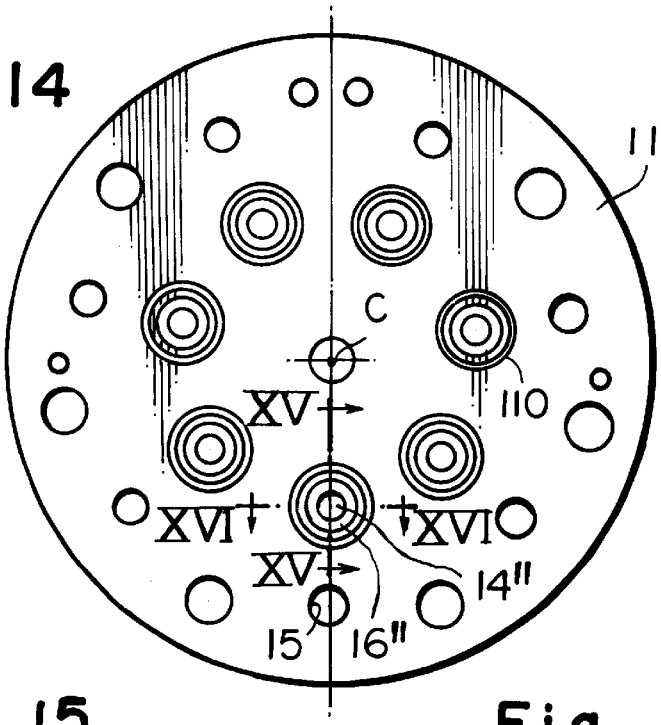
FIG. 14 is a plan view of a valve plate according to another embodiment of the present invention.

FIGS. 14–17 depict another embodiment of the present invention. Referring to FIG. 14, a plan view of valve plate 11 from the discharge chamber side is depicted. Discharge holes 14" and suction holes 15 are disposed equiangularly in valve plate 11 with respect to the center C. On the surface of valve plate 11, valve seat grooves 110 are provided around each discharge hole 14". Valve seat groove 110 prevents valve reed 12 from sticking to valve plate 11.

Figure 15:
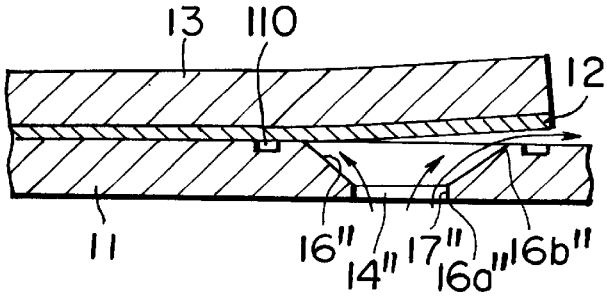
FIG. 15 is a cross-sectional view along line XV—XV of the valve plate depicted in FIG. 14.
Figure 16:
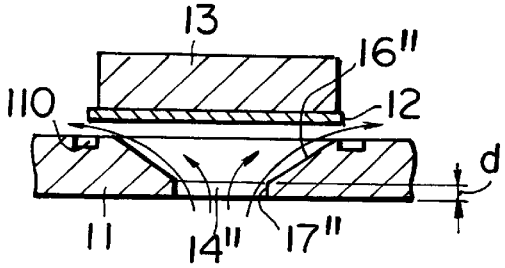
FIG. 16 is a cross-sectional view along line XVI—XVI of the valve plate depicted in FIG. 14.

FIGS. 15 and 16 depict the cross-sectional view of the discharge mechanism during the compression phase. Valve reed 12 is fixed between valve plate 11 and valve retainer 13. Discharge hole 14" comprises a tapered sidewall 16" and a perpendicular part 17". Small circular opening 16*a*" is the piston cylinder-end opening of perpendicular part 17". Large circular opening 16*b*" is the discharge chamber-end opening of sidewall 16".

Figure 17:
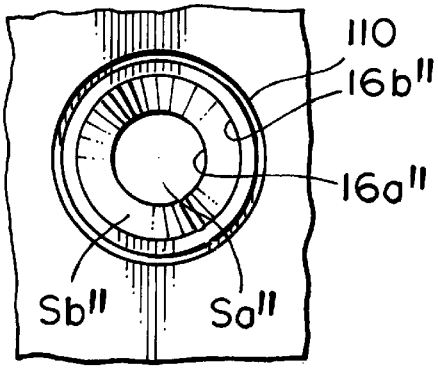
FIG. 17 is a partial plan view of the discharge hole depicted in FIG. 14.

Referring to FIG. 17, opening area Sa" is defined by small circular opening 16*a*", and opening area Sb" is defined by large circular opening 16*b*". In this embodiment, area Sb" is approximately 1.5 times greater than area Sa". Therefore, tapered sidewall 16" allows area Sa" on the piston cylinder-side surface of valve plate 11 to increase gradually to area Sb" on the discharge chamber-side surface of valve plate 11. Further, with reference to FIG. 16, the height of perpendicular part 17" is greater than or equal to zero.

Figure 18:
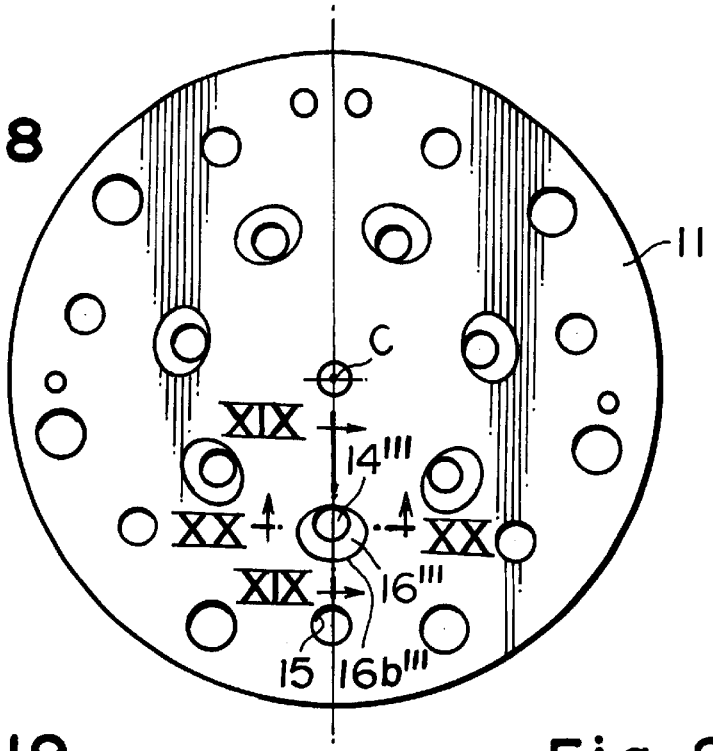
FIG. 18 is a plan view of a valve plate according to another embodiment of the present invention.
Figure 19:
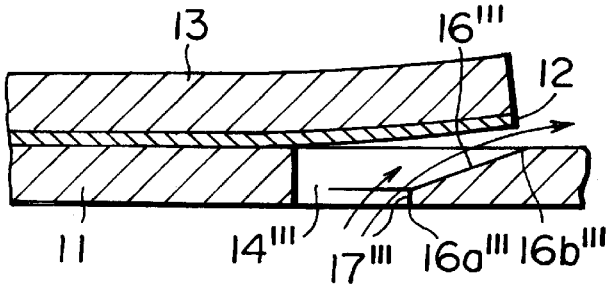
FIG. 19 is a cross-sectional view along line XIX—XIX of the valve plate depicted in FIG. 18.
Figure 20:
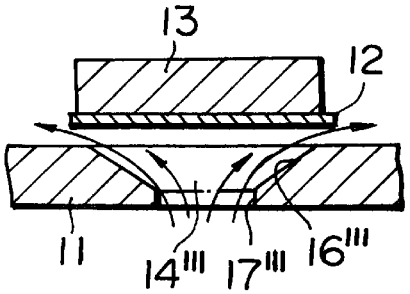
FIG. 20 is a cross-sectional view along line XX—XX of the valve plate depicted in FIG. 18.

FIGS. 18–21 depict another embodiment of the present invention. Referring to FIG. 18, a plan view of valve plate 11 seen from the discharge chamber-side is depicted. Discharge holes 14'" and suction holes 15 are disposed equiangularly in valve plate 11 with respect to center C. FIGS. 19 and 20 depict the cross-sectional view of the discharge mechanism during the compression phase. Valve reed 12 is fixed between valve plate 11 and valve retainer 13. Discharge hole 14'" comprises a partially tapered sidewall 16'", a cylindrical portion 19'" and a perpendicular part 17'". Small circular opening 16*a*'" is the piston cylinder- end opening of perpendicular part 17'". Large elliptical opening 16*b*'" is the discharge chamber-end opening of tapered sidewall 16'".

Figure 21:
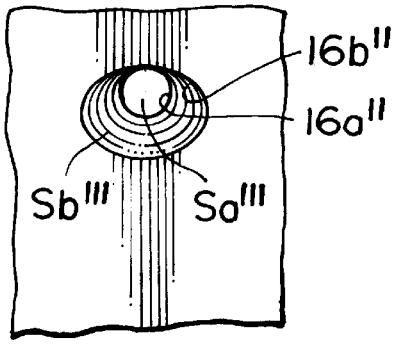
FIG. 21 is a partial plan view of the discharge hole depicted in FIG. 18.

In this embodiment, large elliptical opening 16*b*'" extends to the radially outer side of discharge hole 14'" with respect to center C of valve plate 11. Referring to FIG. 21, opening area Sa'" is defined by small circular opening 16*a*'", and opening area Sb'" is defined by large elliptical opening 16*b*'". In this embodiment, area Sb'" is about 1.5 times greater than area Sa'". Therefore, partially tapered sidewall 16'" allows area Sa'" on the piston cylinder- side surface of valve plate 11 to increase gradually to area Sb'" on the discharge chamber-side surface of valve plate 11.

Figure 22:
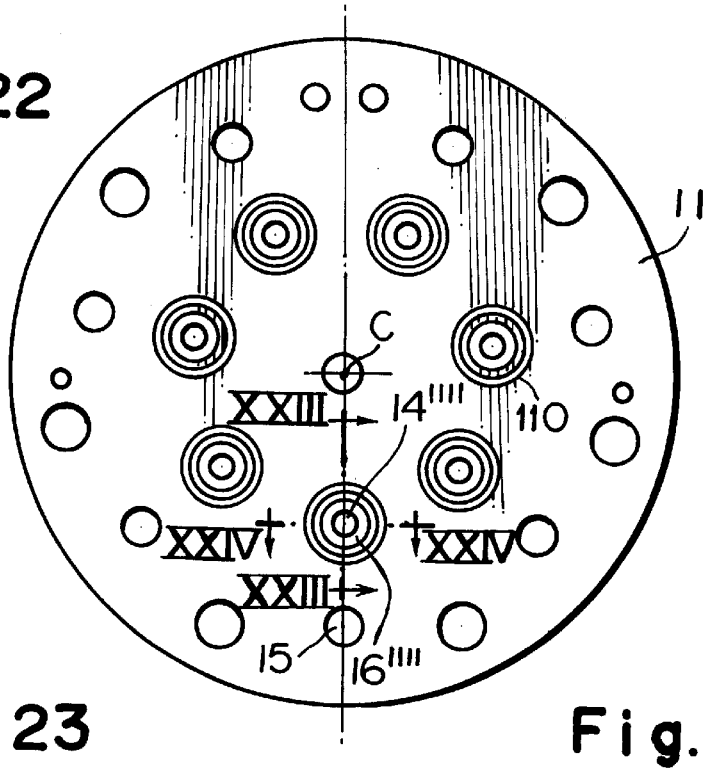
FIG. 22 is a plan view of a valve plate according to another embodiment of the present invention.

FIGS. 22–25 depict another embodiment of the present invention. Referring to FIG. 22, a plan view of valve plate 11 from the discharge chamber side is depicted. Discharge holes 14"" and suction holes 15 are disposed equiangularly in valve plate 11 with respect to the center C. On the surface of valve plate 11, valve seat grooves 110 are provided around each discharge hole 14"". Valve seat groove 110 prevents valve reed 12 from sticking to valve plate 11.

Figure 23:
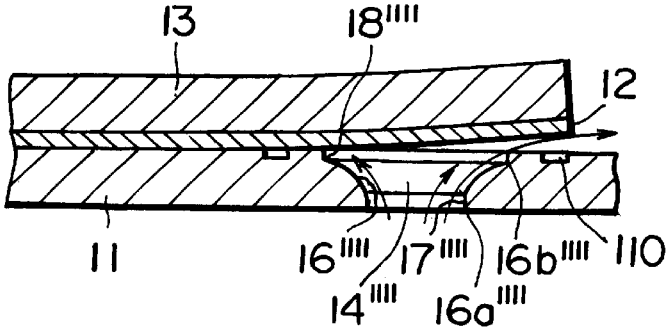
FIG. 23 is a cross-sectional view alone line XXIII—XXIII of the valve plate depicted in FIG. 22.
Figure 24:
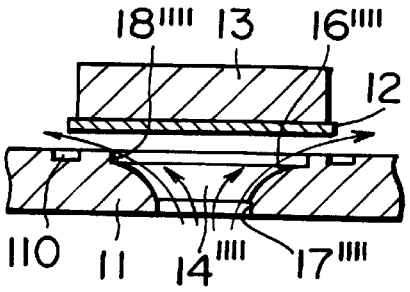
FIG. 24 is a cross-sectional view along line XXIV—XXIV of the valve plate depicted in FIG. 22.

FIGS. 23 and 24 depict the cross-sectional view of the discharge mechanism during the compression phase. Valve reed 12 is fixed between valve plate 11 and valve retainer 13. Discharge hole 14"" comprises a tapered sidewall 16"", a piston cylinder-side perpendicular straight part 17"" and a discharge chamber-side perpendicular straight port 18"". Small circular opening 16*a*"" is the piston cylinder-end opening of perpendicular part 17"". Large circular opening 16*b*"" is the discharge chamber-end opening of perpendicular port 18"". The axial length of each of perpendicular ports 17"" and 18"" is designed not to affect the gas flow through discharge hole 14"".

Figure 25:
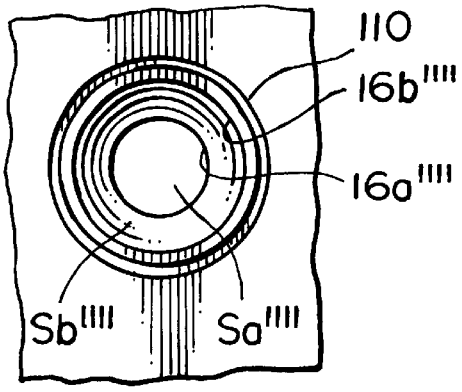
FIG. 25 is a partial plan view of the discharge hole depicted in FIG. 22.

Referring to FIG. 25, opening area Sa"" is defined by small circular opening 16*a*"", and opening area Sb"" is defined by large circular opening 16*b*"". In this embodiment, area Sb"" is approximately 1.5 times greater than area Sa"". Therefore, tapered sidewall 16"" allows area Sa"" on the piston cylinder-side surface of valve plate 11 to increase gradually to area Sb"" on the discharge chamber-side surface of valve plate 11.

In this embodiment, because axially straight portions 17"" and 18"" perpendicular to the respective surfaces of value plate 11 at positions respective adjacent to the respective surfaces of value plate 11, at an appropriate axial length, even if the surfaces of value plate 11 are ground after forming discharge hole 14"", the sectional shape and the diameter of discharge hole 14"" may not charge. Even if an inclined surface is formed as the surface of value plate" by grinding, the sectional shape and the diameter of discharge hole 14"" substantially may not change. Consequently, the control of the dimensions may be easy, the quality of value plate 11 may be stabilized, and the quality of the compressor may be improved.

Figure 26:
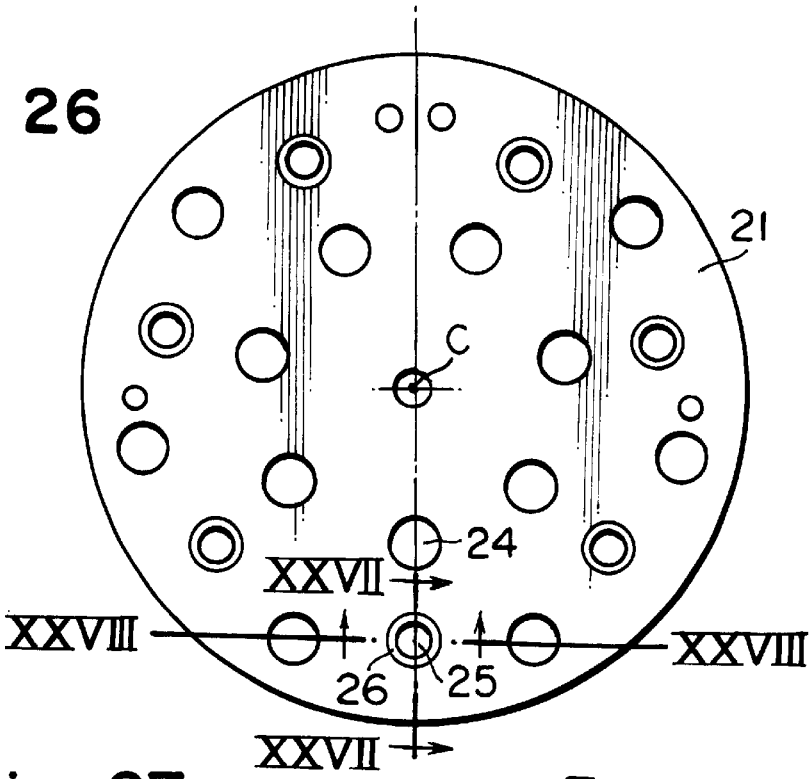
FIG. 26 is a plan view of a valve plate according to another embodiment of the present invention.
Figure 27:
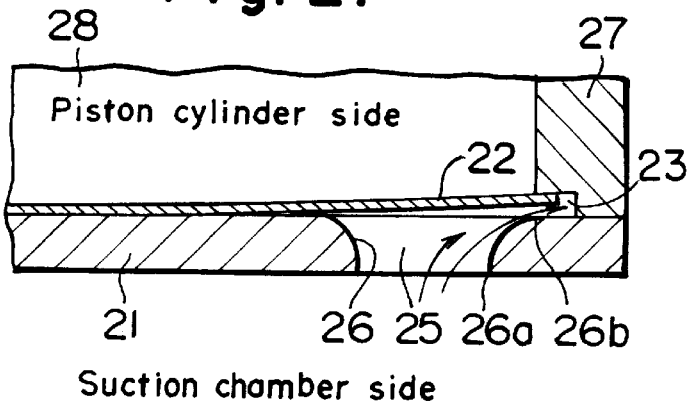
FIG. 27 is a cross-sectional view alone line XXVII—XXVII of the valve plate depicted in FIG. 26.
Figure 28:
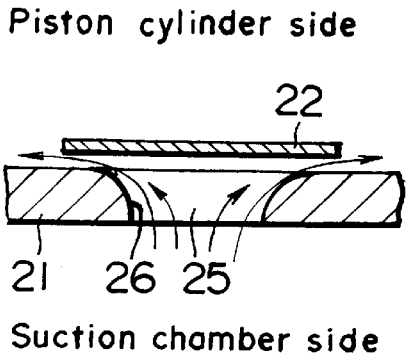
FIG. 28 is a cross-sectional view along line XXVIII—XXVIII of the valve plate depicted in FIG. 26.

FIGS. 26–29 depict another embodiment of the present invention. Referring to FIG. 26, a plan view of valve plate 21 from the piston cylinder-side is depicted. Discharge holes 24 and suction holes 25 are disposed equiangularly in valve plate 21 with respect to the center C. FIGS. 27 and 28 depict the cross-sectional view of the suction mechanism during the suction phase. With reference to FIG. 27, vibration of valve reed 22 is limited by a groove 23 provided at end of housing 27. Suction hole 25 includes a convex tapered sidewall 26. Small circular opening 26*a* is the suction chamber-end opening of tapered sidewall 26. Large circular opening 26*b* is the piston cylinder-end opening of tapered sidewall 26.

Figure 29:
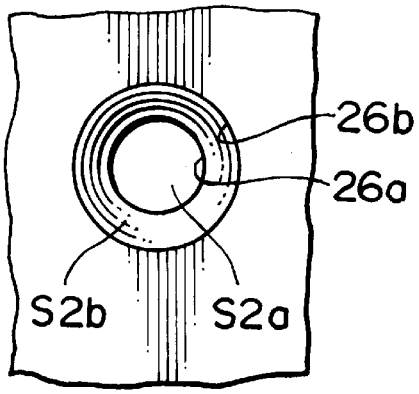
FIG. 29 is a partial plan view of the discharge hole depicted in FIG. 26.

Referring to FIG. 29, opening area S2*a* is defined by small circular opening 26*a*, and opening area S2*b* is defined by large circular opening 26*b*. In this embodiment, area S2*b* is about 1.5 times greater than area S2*a*. The curve of convex tapered sidewall 26 allows area S2*a* on the suction chamber-side surface of valve plate 21 to increase gradually to area S2*b* on the piston cylinder-side surface of valve plate 21. Thus, the circumference of suction hole 25 increases from the suction chamber-side surface of valve plate 21 to the piston cylinder surface. The shapes of the holes depicted in FIGS. 6–25 and described with respect to discharge holes are applicable to and suitable for suction holes.

Thus, the present invention provides a convex tapered sidewall or a tapered sidewall with cylindrical portions in a discharge hole or in a suction hole, or both. As a result, the turbulence of the refrigerant flow passing through the discharge holes or the suction holes, or both, may be reduced. Accordingly, the flow resistance for the refrigerant gas through the discharge holes and suction holes decreases, so that the volumetric efficiency of the compressor may be improved and related noise suppressed.

The present invention is applicable to any type of compressor that has a reed valve mechanism. For example, the present invention may be applied to swash plate-type compressors, wobble plate-type compressor, scroll-type compressor, or rotary-type compressor. Although the present invention has been described in detail in connection with preferred embodiments, the invention is not limited thereto. It will be understood by those of ordinary skill in the art that variations and modifications may be made within the scope of this invention, as defined by the following claims.

What is claimed is:

1. A compressor having a discharge valve mechanism, comprising:

a valve plate having at least one discharge passage for providing fluid communication between a piston cylinder and a discharge chamber, a discharge valve reed, and a valve retainer; and said at least one discharge passage comprising a first piston cylinder-side opening having a first cylinder-side opening area, a discharge chamber-side opening having a discharge chamber-side opening area, and a sidewall extending between said openings, wherein at least a portion of said discharge passage sidewall is continuously tapered throughout said discharge passage, and wherein said discharge chamber-side opening area is greater than said first piston cylinder-side opening area.

2. The compressor of claim 1, wherein said valve plate has a valve plate thickness and said tapered discharge passage sidewall portion has a tapered sidewall height, such that said valve plate thickness is greater than said tapered sidewall height.

3. The compressor of claim 1, wherein said discharge passage sidewall further includes a substantially cylindrical portion.

4. The compressor of claim 1, wherein said first piston cylinder-side opening has a circular circumferential shape.

5. The compressor of claim 1, wherein said discharge chamber-side opening has a circular circumferential shape.

6. The compressor of claim 1, wherein said discharge chamber-side opening has an elliptical circumferential shape.

7. The compressor of claim 1, wherein said discharge passage sidewall further includes a cylindrical portion having a straight sidewall in an axial direction of said discharge passage at at least one of a piston cylinder-side end and a discharge chamber-side end of said discharge passage.

8. The compressor of claim 7, wherein said straight sidewall-cylindrical portion has an axial length that does not affect a gas flow through said discharge passage.

9. The compressor of claim 1, further comprising:

a suction valve mechanism comprising said valve plate having at least one suction passage for providing fluid communication between a suction chamber and said piston cylinder, a suction valve reed, and a means for limiting a motion of said suction valve reed, wherein said at least one suction passage has a second piston cylinder-side opening having a second piston cylinder-side opening area, a suction chamber-side opening having a suction chamber-side opening area, and a sidewall extending between said openings, wherein at least a portion of said suction passage sidewall is tapered, and wherein said second piston cylinder-side opening area is greater than said suction chamber-side opening area.

10. A compressor having a suction valve mechanism, comprising:

a valve plate having at least one suction passage for providing fluid communication between a suction chamber and a piston cylinder, a suction valve reed, and means for limiting a motion of said suction valve reed; and said at least one suction passage comprises a first piston cylinder-side opening having a first piston cylinder-side opening area, a suction chamber-side opening having a suction chamber-side opening area, and a sidewall extending between said openings, wherein at least a portion of said suction passage sidewall is continuously tapered throughout said passage, and wherein said first piston cylinder-side opening area is greater than said suction chamber-side opening area.

11. The compressor of claim 10, wherein said valve plate has a valve plate thickness and said tapered suction passage sidewall portion has a tapered sidewall height, such that said valve plate thickness is greater than said tapered sidewall height.

12. The compressor of claim 10, wherein said suction passage sidewall further includes a substantially cylindrical portion.

13. The compressor of claim 10, wherein said suction chamber-side opening has a circular circumferential shape.

14. The compressor of claim 10, wherein said piston cylinder-side opening has a circular circumferential shape.

15. The compressor of claim 10, wherein said piston cylinder-side opening has an elliptical circumferential shape.

16. The compressor of claim 10, wherein said suction passage sidewall further includes a cylindrical portion having a straight sidewall in an axial direction of said suction passage at at least one of a piston cylinder-side end and a suction chamber-side end of said suction passage.

17. The compressor of claim 16, wherein said straight sidewall-cylindrical portion has an axial length that does not affect a gas flow through said suction passage.

18. The compressor of claim 10, further comprising:

a discharge valve mechanism comprising said valve plate having at least one discharge passage providing fluid communication between a discharge chamber and said piston cylinder, a discharge valve reed, and a valve retainer, wherein said at least one discharge passage has a second piston cylinder-side opening having a second piston cylinder-side opening area, a discharge chamber-side opening having a discharge chamber-side opening area, and a sidewall extending between said openings, wherein at least a portion of said discharge passage sidewall is tapered, and wherein said discharge chamber-side opening area is greater than said second piston cylinder-side opening area.

19. A compressor having a discharge valve mechanism, comprising:

a valve plate having at least one discharge passage for providing fluid communication between a piston cylinder and a discharge chamber, a discharge valve reed, and a valve retainer; and said at least one discharge passage comprising a first piston cylinder-side opening having a first cylinder-side opening area, a discharge chamber-side opening having a discharge chamber-side opening area, and a sidewall extending between said openings, wherein at least a portion of said discharge passage sidewall is tapered, and wherein a rate of taper of said tapered portion is non-linear and non-uniform and increases between said first cylinder-side opening area and said discharge chamber-side opening area, and wherein said discharge chamber-side opening area is greater than said first piston cylinder-side opening area.

20. A compressor having a discharge valve mechanism, comprising:

a valve plate having at least one discharge passage for providing fluid communication between a piston cylinder and a discharge chamber, a discharge valve reed, and a valve retainer; and said at least one discharge passage comprising a first piston cylinder-side opening having a first cylinder-side opening area, a discharge chamber-side opening having a discharge chamber-side opening area, and a sidewall extending between said openings, wherein at least a portion of said discharge passage sidewall is tapered to said first piston cylinder-side opening, and wherein said discharge chamber-side opening area is greater than said first piston cylinder-side opening area.

21. A compressor having a discharge valve mechanism, comprising:

a valve plate having at least one discharge passage for providing fluid communication between a piston cylinder and a discharge chamber, a discharge valve reed positioned in the same plane as said valve plate, and a valve retainer, said at least one discharge passage comprising a first piston cylinder-side opening having a first cylinder-side opening area, a discharge chamber-side opening having a discharge chamber-side opening area, and a sidewall extending between said openings, wherein at least a portion of said discharge passage sidewall is tapered, and wherein a rate of taper of said tapered portion is non-linear and increases between said first cylinder-side opening area and said discharge chamber-side opening area, and wherein said discharge chamber-side opening area is greater than said first piston cylinder-side opening area.

22. A compressor having a discharge valve mechanism, comprising:

a valve plate having at least one discharge passage for providing fluid communication between a piston cylinder and a discharge chamber, a discharge valve reed positioned in the same plane as said valve plate, and a valve retainer, said at least one discharge passage comprising a first piston cylinder-side opening having a first cylinder-side opening area, a discharge chamber-side opening having a discharge chamber-side opening area, and a sidewall extending between said openings, wherein at least a portion of said discharge passage sidewall is tapered to said first piston cylinder-side opening, and wherein said discharge chamber-side opening area is greater than said first piston cylinder-side opening area.

* * * * *